United States Patent [19]

Mattei et al.

[11] Patent Number: 4,693,051

[45] Date of Patent: Sep. 15, 1987

[54] MACHINE FOR BOXING ITEMS IN GROUPS

[75] Inventors: Riccardo Mattei, Bologna; Giordano Gorrieri, Pianoro; Gualtiero Filippini, Bologna, all of Italy

[73] Assignee: G.D Societa' per Azioni, Bologna, Italy

[21] Appl. No.: 930,540

[22] Filed: Nov. 14, 1986

[30] Foreign Application Priority Data

Dec. 20, 1985 [IT] Italy ..... 3652 A/85

[51] Int. Cl.[4] ..... B65B 19/34; B65B 35/50; B65B 47/04

[52] U.S. Cl. ..... 53/148; 53/537; 53/540; 53/563; 53/574

[58] Field of Search ..... 53/563, 564, 540, 537, 53/531, 148, 574, 559, 236, 247, 250

[56] References Cited

U.S. PATENT DOCUMENTS

| | | | |
|---|---|---|---|
| 3,479,795 | 11/1969 | Martin | 53/537 X |
| 3,657,860 | 4/1972 | Franklin | 53/537 X |
| 3,670,474 | 6/1972 | Vieson et al. | 53/537 X |
| 3,851,439 | 12/1974 | Pillon | 53/563 X |
| 3,941,037 | 3/1976 | Reichert | 53/563 X |
| 4,398,383 | 8/1983 | Prakken | 53/537 |
| 4,578,929 | 4/1986 | Tisma | 53/563 X |

*Primary Examiner*—Horace M. Culver

*Attorney, Agent, or Firm*—Marshall, O'Toole, Gerstein, Murray & Bicknell

[57] ABSTRACT

A machine for boxing items in groups, in particular sticks of sweets or similar, on which the sticks are fed in successive layers into a compartment for forming the aforementioned groups, which compartment is open vertically and designed to move, along a supporting surface, between a loading position and a bending position; in which bending position, each group is placed on the center portion of a respective blank which is bent about the group by a box-shaped bending assembly; the aforementioned bending operation being performed in two stages, during the first of which, the aforementioned bending assembly moves in relation to the blank and the group which are stationary, and during the second of which, the group and the blank are moved through the bending assembly by virtue of two opposed pushers.

12 Claims, 3 Drawing Figures

MACHINE FOR BOXING ITEMS IN GROUPS

BACKGROUND OF THE INVENTION

The present invention relates to a machine for boxing items in groups.

In particular, the present invention relates to a machine suitable for group-boxing sticks of sweets.

In the following description, the term "boxing machine" is intended to mean a machine designed to receive, in succession, a number of loose items, usually long and regular in shape, and to arrange them in a given number of superimposed layers inside a container usually open at the top. On lines manufacturing loose items of the aforementioned type, the finished items are generally boxed by hand. The said items, in fact, are usually fed, transversely in relation to their axes, to a finish boxing department where they are picked up in groups by the operators and arranged manually in successive layers inside open-topped containers, which serve both for packing and shop display purposes.

SUMMARY OF THE INVENTION

The aim of the present invention is to provide a boxing machine enabling simple, straightforward mechanization of the aforementioned boxing operation.

With this aim in view, according to the present invention, there is provided a machine for boxing items in groups, in particular, sticks of sweets, characterised by the fact that it comprises a combination of at least one pocket member open at the top and bottom and designed to receive a neatly arranged group of the said items; a supporting plate arranged substantially contacting the open bottom end of the said pocket member; mobile supporting means for moving the said pocket member, along the said plate, between two positions wherein the said group of items is loaded and boxed respectively; feeding means located in the said loading position and designed to form a said group of items inside the said pocket member and on the said supporting plate; a cardboard blank feeding assembly for successively feeding cardboard blanks onto the said plate in the said boxing position, the said plate presenting an opening in the said boxing position; mobile retaining means for securing each blank on the said plate in such a position as to cover the said opening; a tubular bending assembly designed to move through the said opening and having an inner passage of substantially the same section as the said group of items; and pushing means located in the said boxing position, for forcing the said group of items and the respective cardboard blank through the said pocket member, the said bending assembly and the said opening, so as to transfer the said group of items from the said boxing position to an unloading position underneath the said plate.

BRIEF DESCRIPTION OF THE DRAWINGS

A non-limiting embodiment of the present invention will be described with reference to the accompanying drawings, in which.

DETAILED DESCRIPTION OF THE INVENTION

Figure 1:
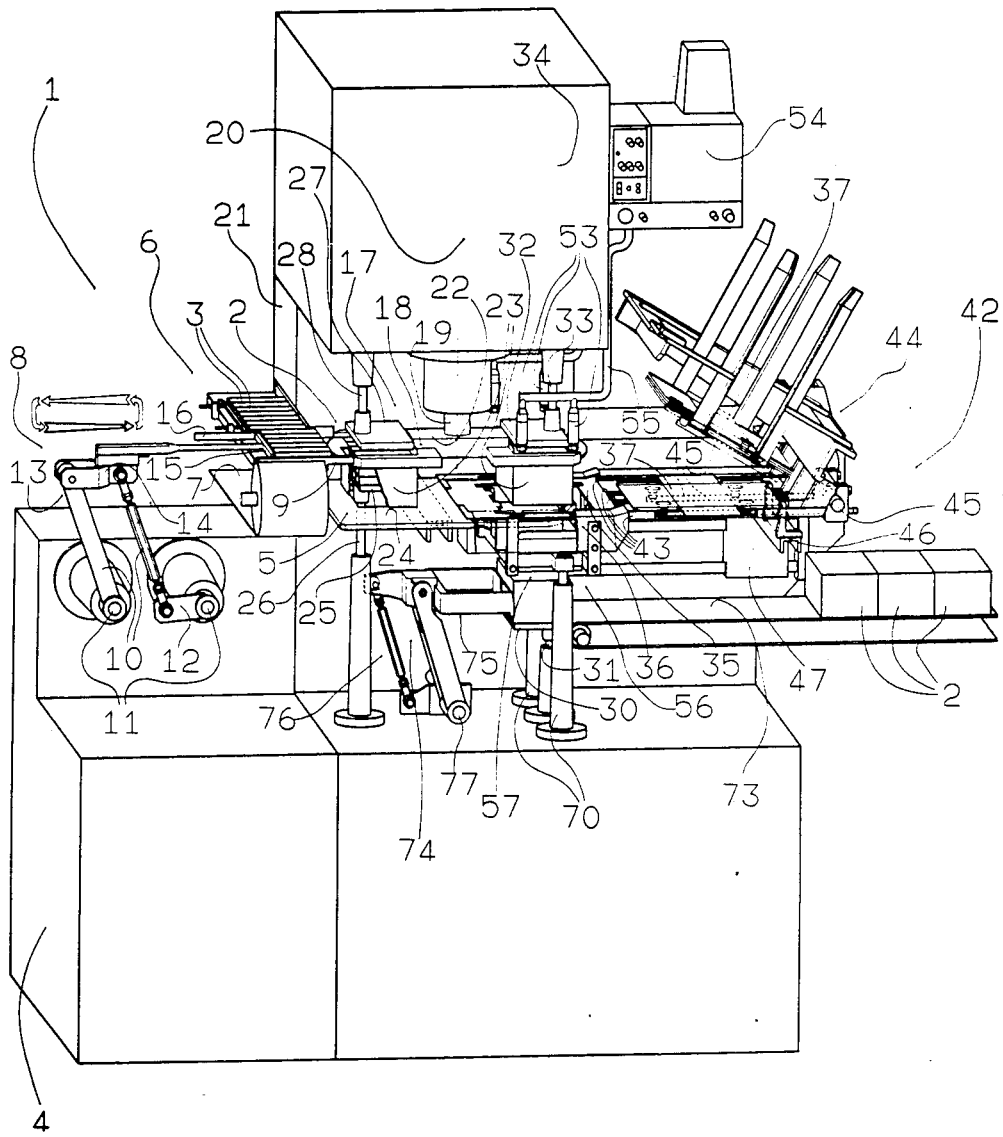
FIG. 1 shows a view in perspective of a boxing machine according to the teachings of the present invention.

Number 1 in FIG. 1 indicates a machine for boxing groups 2 of items which, in the example shown, consist of sticks of sweets 3.

Machine 1 comprises a bed 4 over the top of which there extends a boxing line 5 supported on bed 4 and comprising an input station 6, consisting of a conveyor belt 7 for feeding sticks 3 transversely in relation to their axes, and a feeding means consisting of a push device 8 designed to engage a given number of sticks 3 resting on conveyor 7 and contacting a stop wall 9 located on bed 4.

As shown in FIG. 1, push device 8 comprises two substantially vertical levers 10. The bottom end of a first of the said levers 10 is hinged to the end of a first substantially horizontal shaft 11 designed to swing the said first lever 10. The bottom end of the second of the said levers 10 is hinged to the end of a crank 12 fitted onto the end of a second shaft 11 parallel with the first and designed to turn the said crank 12 and to move the respective lever 10 back and fourth substantially axially. The said levers 10 constitute the connecting rods of an articulated parallelogram 13 lying in a vertical plane perpendicular to conveyor 7 and comprising, in addition to crank 12, a crank 14 hinged to the top ends of levers 10.

Crank 14 extends beyond levers 10, in the direction of conveyor 7, and is fitted, on its free end, with a plate 15 designed to cooperate with the axial ends of the said given number of sticks 3 arranged contacting stop wall 9 on conveyor 7.

To one end of plate 15, upstream in relation to the traveling direction of conveyor 7, there is connected a stop rod 16 of at least the same length as sticks 3 and extending parallel with crank 14 in the direction of parallelogram 13.

Downstream from input station 6, boxing line 5 also comprises a device 17 for forming groups 2 and comprising a mobile supporting means or indexing fixture 18 a centre portion of which is connected to the bottom end of a substantially vertical output shaft 19 on a drive device 20 supported over boxing line 5 on an upright 21 extending upwards from the upper middle portion of bed 4.

Indexing fixture 18 comprises a crosspiece 22 perpendicular to shaft 19 and the middle portion of which is connected to the free end of the same. To each end of cross-piece 22, there is connected a bending assembly consisting of a compartment or box-shaped pocket member 23 open at the top and bottom and designed to move, subsequent to 180° rotation of indexing fixture 18, between a loading and a boxing position.

When in the said loading position, box-shaped member 23 is located adjacent to plate 15 and over a supporting surface consisting of a plate 24 supported on upright 21 and arranged substantially contacting the open bottom end of box-shaped member 23. The portion of plate 24 directly underneath the said box-shaped member 23 is defined by a plate 25 constituting the top end of a vertical pusher 26. Pusher 26 may be activated for moving plate 25 between a lowered position, aligned with the rest of plate 24, and a raised position wherein plate 25 is arranged inside box-shaped member 23, in line with the top branch of conveyor 7 and facing a further plate 27. Plate 27 is designed to move vertically and constitutes the end portion of a pusher 28 substantially coaxial with pusher 26 and projecting downwards from drive device 20.

Figure 2:
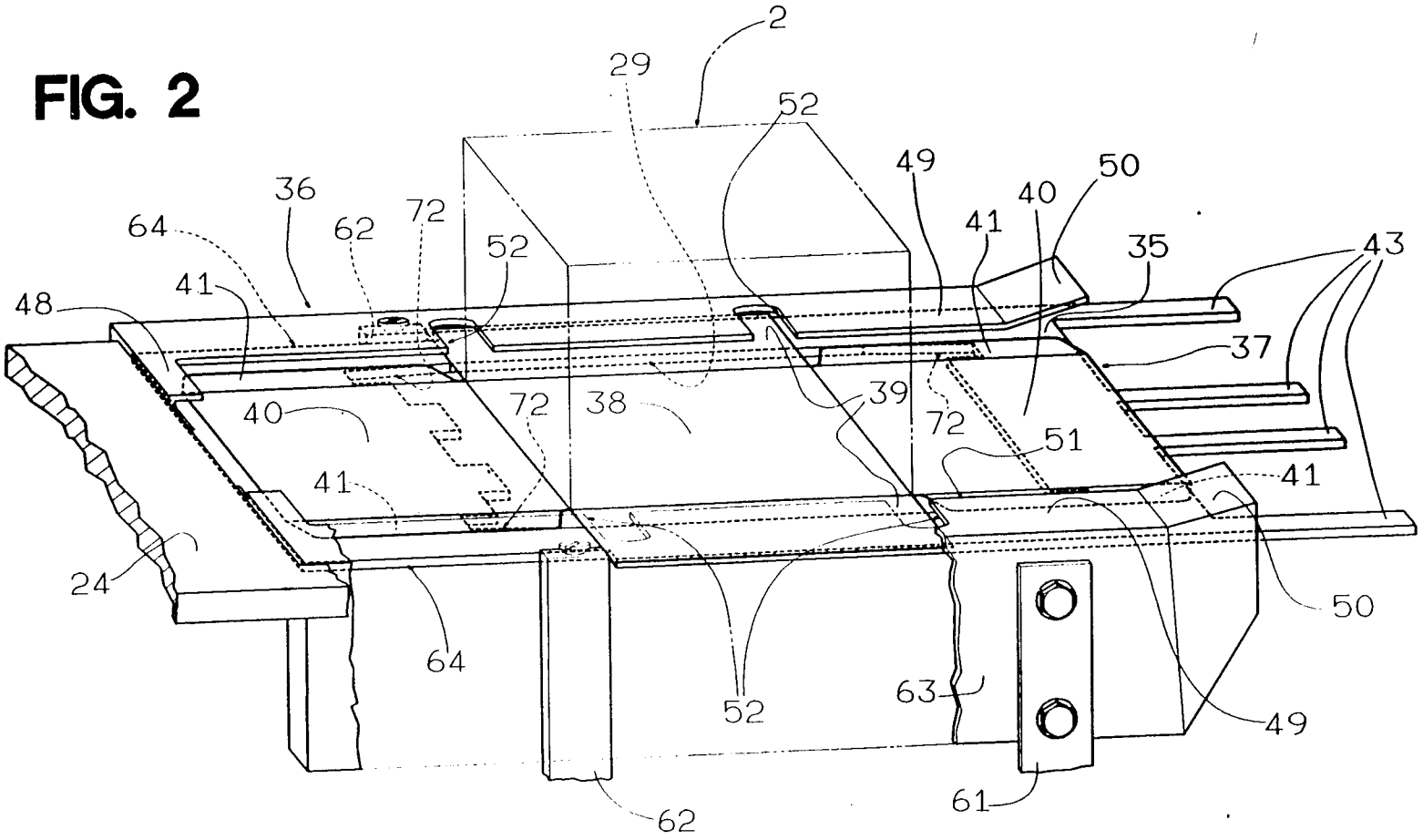
FIG. 2 and 3 show two enlarged views respectively of details in FIG. 1.
Figure 3:
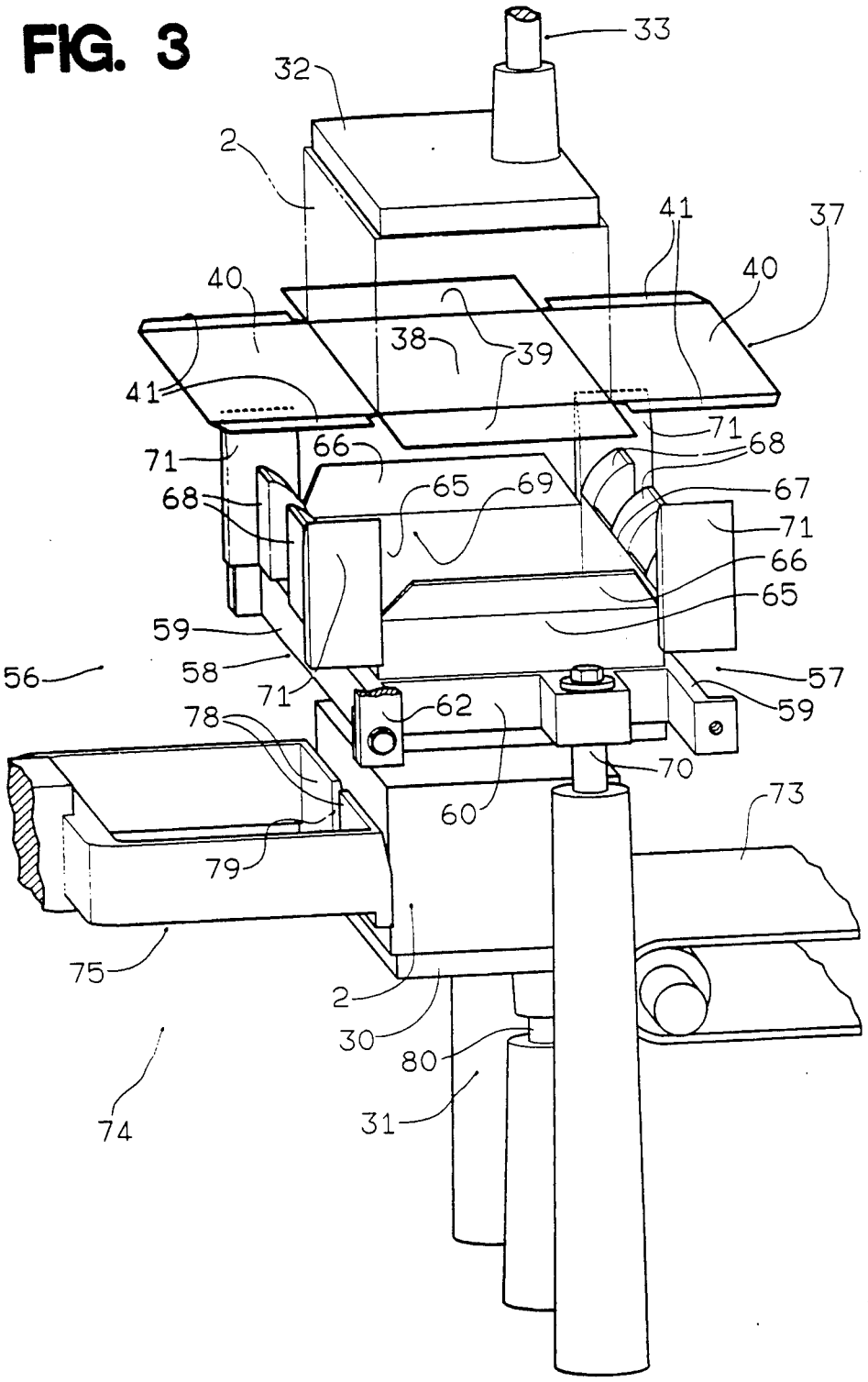

When in the said boxing position, box-shaped member 23 is located directly over an opening 29 formed through plate 24 and engaged by a plate 30 (FIGS. 2 and 3). Plate 30 constitutes the top end of a pusher 31 extending vertically upwards from bed 4 and which may be activated for moving plate 30 between a raised position, substantially flush with the top surface of plate 24, and a lowered position wherein plate 30 is located close to bed 4 and at a level described in more detail later on.

When in the said boxing position, box-shaped member 23 is also located directly underneath a plate 32 facing opposite plate 30 and constituting the bottom end of a pusher 33 coaxial with pusher 31. Pusher 33 extends vertically downwards from outer casing 34 on device 20 supported on upright 21, and may be activated for moving plate 32, in the same way as plate 30, through the said opening 29.

As shown, particularly in FIG. 2, opening 29 is formed through a sunken portion 35 of plate 24 and is framed by retaining means comprising a sheet metal frame 36 designed to retain a blank 37 designed for bending in a prearranged manner, consisting of cardboard or other similar sheet material, and arranged contacting sunken portion 35 in such a position as to cover opening 29.

The said blank 37 comprises a centre portion 38 substantially in the form of a parallelogram, substantially of the same shape as the horizontal section of groups 2, and slightly smaller in size than opening 29. From two opposite side edges of the said centre portion 38, two bendable tabs 39 extend outwards, perpendicular to the longitudinal axis of plate 24. From the other two opposite side edges of centre portion 38, there extend outwards a further two bendable tabs 40, each having two bendable side tonges 41.

As shown in FIG. 1, blank 37 is fed into the said position covering opening 29 by a known type of feed unit 42 comprising slide rails 43 connected to the end of plate 24 opposite the end facing conveyor 7; a store 44 for accommodating a stack of blanks 37; two suction bars 45 for successively withdrawing blanks 37 from the bottom of store 44 and mounted so as to rock about a powered shaft 45' located over slide rails 43 in such a manner as to oscillate, in relation to the same, between a raised idle position and a lowered feed position; and a retaining and thrust device 46 designed to retain on slide rails 43 the blank 37 withdrawn from the bottom of store 44, and to push it, by virtue of an actuating device 47, into the said position covering opening 29 on the sunken portion 35 of plate 24.

As shown in FIG. 2, frame 36 presents a substantially C-shaped horizontal section open on the side facing feed unit 42, and comprises an intermediate arm 48 arranged transversely in relation to slide rails 43, and two side arms 49 parallel with slide rails 43 and having, on the free ends facing rails 43, an upward-slanting portion 50 for inviting blank 37 underneath frame 36 and into the said position covering opening 29. When blank 37 is arranged in the said position covering opening 29, arm 48 covers an end portion of one of tabs 40 located on sunken portion 35 of plate 24, outwards of opening 29; whereas each side arm 49 covers an end portion of a respective tab 39 located on sunken portion 35 of plate 24, outwards of opening 29.

Arms 48 and 49 thus define a substantially rectangular opening 51 centered on opening 29, but greater in size than opening 29, and smaller in size than the rectangle formed by blank 37 in the said position covering opening 29.

Each of arms 49 presents, over respective tab 39, two transverse slots 52 constituting gumming openings for respective gumming devices 53 supported (in a manner not shown) by a box-shaped body 54 on drive device 20, and connected by pipes 55 to a gum supply unit (not shown) inside box-shaped body 54.

As shown also in FIG. 3, pushers 31 and 33 and frame 36 form part of a boxing unit 56, which also comprises a tubular bending assembly or frame 57 coaxial with opening 29 and comprising a frame 58 substantially in the form of a parallelepipedon and consisting of a first pair of rods 59, parallel with conveyor 7, and a second pair of parallel rods 60 perpendicular to rods 59 and the ends of which are connected integral with the same. The opposite ends of both rods 59 project beyond the connecting points with rods 60, and are fitted, one with two uprights 61, and the other with two uprights 62. Uprights 61 extend upwards from frame 58 and are connected, at the top end, to walls 63 extending downwards from respective side arms 49 on frame 36, outside the longitudinal side edges of sunken portion 35. Uprights 62, on the other hand, extend upwards from frame 58, as far as the underside of respective side arms 49, through respective slots 64 in sunken portion 35 of plate 24, and are connected integral with frame 36.

To the inner surface of each rod 60, there is connected a vertical plate 65 having an upper portion 66 slanting outwards, so as to define an inclined inviting surface, and which, as described later on, constitutes a means for bending tabs 39 on blanks 37. To the inner surface of each rod 59, there is connected a vertical plate 67, from the centre portion of the top edge of which, there project upwards two substantially triangular appendixes or bending means 68 defining an inclined inviting surface. Plates 65 and 67 combine to define an opening 69 aligned with the centre portion 38 of blank 37 when the latter is arranged in the said position covering opening 29. The cross section of opening 69 is substantially the same as centre portion 38, while the overall size of frame 58 is such as to enable the same to move vertically through opening 29 by virtue of two vertical linear actuators 70 arranged on opposite sides in relation to pusher 31 and connected, at the bottom, to bed 4, and, at the top, to rods 60. Finally, from the top edge of each plate 67, there extend upwards two uprights or bending means 71, each of which projects over the ends of appendixes 68 and is aligned with a respective lateral tongue 41 on blank 37 in the said position covering opening 29, and with a respective recess 72 formed through sunken portion 35 of plate 24 along the periphery of opening 29 (see also FIG. 2).

Bending assembly 57 is designed to move vertically, by virtue of actuators 70 and together with frame 36, between a raised position, wherein bending assembly 57 extends at least partially over sunken portion 35 of plate 24, and a lowered position wherein bending assembly 57 is located underneath sunken portion 35.

Plate 32 is designed to move vertically, through opening 69, between a raised position contacting the underside of blank 37 in the said position covering opening 29, and a lowered position wherein plate 32 is located underneath bending assembly 57 in the said lowered position, the clearance between the said two lowered positions being equal to at least the height of groups 2.

When in the said lowered position, plate 32 is aligned with the top branch of a horizontal unloading conveyor 73 supported on bed 4 and extending perpendicular to conveyor 7. On the opposite side of conveyor 73 in relation to plate 32, there is provided an unloading device 74 supported on bed 4 and consisting of a push member 75 designed to move horizontally to and from conveyor 73 and over plate 32 in the said lowered position, by virtue of an articulated parallelogram 76, one shaft 77 of which is powered.

Push member 75 is shaped substantially in the form of a horizontal "C" having its open end facing conveyor 73 and fitted with two vertical push plates 78 separated by a slot 79 wide enough to enable the passage of a drive shaft 80 on pusher 31.

In actual use, as soon as an empty box-shaped member 23 is moved by indexing fixture 18 into the loading position, plate 25 of pusher 26 is moved up, inside box-shaped member 23, as far as the top branch of conveyor 7. Push device 8 is then activated for transferring a first group of sticks 3, arranged contacting wall 9, onto plate 25, and, at the same time, preventing sticks 3 from being fed along conveyor 7, by means of stop rod 16.

With the aid of pusher 28, plate 25 is then lowered inside box-shaped member 23 by an amount equal to the thickness of the newly loaded layer of sticks 3, so as to enable loading of a further layer. The above loading cycles are repeated until plate 25 descends as far as plate 24, and a complete group 2 has been formed inside box-shaped member 23.

At this point, counterpressure plate 27 is finally raised so as to enable indexing fixture 18 to rotate, and the newly formed group 2 on plate 24 to slide into the boxing position. While the aforementioned loading operations are being performed, a previously formed group 2, inside respective box-shaped member 23 in the boxing position over opening 29, is boxed.

At the start of the boxing sequence, a blank 37, in the said position covering opening 29, is gripped between sunken portion 35 of plate 24 and frame 36; the upper surface of frame 36 is aligned with the upper surface of plate 24; and plates 30 and 32 are arranged respectively contacting the bottom surface of blank 37 and the upper surface of the group 2 to be boxed.

At this point, gumming devices 53 direct jets of gum, through slots 52, onto lateral end portions on the inner surface of tabs 39.

Actuators 70 are then activated for moving up bending assembly 37 and frame 36. Such displacement frees blank 37 from frame 36 and brings uprights 71 into contact with tongues 41, which are bent up squarely. Subsequently, as bending assembly 57 proceeds upwards through opening 29, portions 66 of plates 65 and appendixes 68 of plates 67 gradually come into contact with tabs 39 and 40 which are bent partially upwards outside box-shaped member 23 and respectively group 2, which is held stationary by pushers 31 and 33.

When the top edges of plates 65 and 67 are flush with the top surface of sunken portion 35 of plate 24, actuators 70 stop and pushers 31 and 33 are moved from the raised position into the lowered position, so as to force group 2 and respective blank 37 through bending assembly 57 and so complete bending of tabs 39 and 40, the tongues 41 of which are gummed to the gummed portions on the inner surface of respective tabs 39.

Once the said lowered position, also referred to as the unloading position, is reached, plate 32 moves back up into the raised position, and articulated parallelogram 76 is activated for feeding boxed group 2 onto conveyor 73.

Before unloading device 72 moves back, plate 30 is moved back up into the raised position through push member 75 and bending assembly 57. At the same time, bending assembly 57 is moved back into the lowered position underneath plate 24, and, before frame 36, moving together with bending assembly 57, reaches the lowered position contacting sunken portion 35 of plate 24, a new blank 37 is fed into the said position covering opening 29. Once plate 30 has moved back up into the raised position, unloading device 74 is allowed to move back by virtue of slot 79 which is wide enough to enable the passage of shaft 80 on pusher 31.

When frame 36 secures the new blank 37 onto the sunken portion 35 and moves into a position flush with the upper surface of plate 24, indexing fixture 18 may turn for transferring the empty box-shaped member 23 into the loading position, and the full box-shaped member 23 into the boxing position.

We claim:

1. A machine for boxing items in groups, in particular, sticks (3) of sweets, characterised by the fact that it comprises a combination of at least one pocket member (23) open at the top and bottom and designed to receive a neatly arranged group (2) of the said items (3); a supporting plate (24, 25) arranged substantially contacting the open bottom end of the said pocket member (23); mobile supporting means (18) for moving the said pocket member (23), along the said plate (24), between two positions wherein the said group (2) of items (3) is loaded and boxed respectively; feeding means (8) located in the said loading position and designed to form a said group (2) of items (3) inside the said pocket member (23) and on the said supporting plate (24, 25); a cardboard blank (37) feeding assembly (42) for successively feeding cardboard blanks (37) onto the said plate (24) in the said boxing position, the said plate (24) presenting an opening (29) in the said boxing position; mobile retaining means (36) for securing each blank (37) on the said plate (24) in such a position as to cover the said opening (29); a tubular bending assembly (57) designed to move through the said opening (29) and having an inner passage of substantially the same section as the said group (2) of items (3); and pushing means (31, 33) located in the said boxing position, for forcing the said group (2) of items (3) and the respective cardboard blank (37) through the said pocket member (23), the said bending assembly (57) and the said opening (29), so as to transfer the said group (2) of items (3) from the said boxing position to an unloading position underneath the said plate (24).

2. A boxing machine as claimed in claim 1, characterised by the fact that the said retaining means (36) and the said tubular bending assembly (57) are arranged the former over the latter and integral with each other.

3. A boxing machine as claimed in claim 1, characterised by the fact that, in the said boxing position, the said plate (24) presents a sunken portion (35); the said retaining means comprising a substantially flat retaining frame (36) designed to move between a lowered position resting on the said sunken portion (35) and a raised position over the same; the upper surface of the said frame (36) being, in the said lowered position, substantially coplanar with the upper surface of the said plate (24).

4. A boxing machine as claimed in claim 3, characterised by the fact that the said retaining frame (36) presents a substantially rectangular opening (51) facing the said opening (29) in the said plate (24) and being greater in size than the said opening (29) and smaller in size than the rectangle formed by a said blank (37) in the said position covering the said opening (29).

5. A boxing machined as claimed in claim 4, characterised by the fact that each said blank (37) comprises a centre portion (38), in the form of a parallelogram, and four tabs (39, 40) each extending outwards from a respective side of the said centre portion (38); each said blank (37), in the said position covering the said opening (29), being arranged with the said centre portion (38) facing the said opening (29) in the said plate (24) and aligned with the said tubular bending assembly (57), and with the said tabs (39, 40) arranged, at least partially, between the said sunken portion (35) of the said plate (24) and the said retaining frame (36); the said centre portion (38) being smaller in size than the said opening (29) in the said plate (24).

6. A boxing machine as claimed in claim 5, characterised by the fact that two opposite said tabs (40) present bendable lateral tongues (41); gumming means (53) being provided for gumming, through the said retaining frame (36), portions of the other two said tabs (39) on a said blank (37) in the said position covering the said opening (39), which portions are designed to come into contact with the said lateral tongues (41).

7. A boxing machine as claimed in claim 6, characterised by the fact that the said tubular bending assembly comprises a boxing frame (57) substantially in the form of a parallelogram and defining the said inner passage; the said passage being aligned with the said centre portion (38) of the said blank (37) in the said position covering the said opening (29) and being of substantially the same shape and size as the said centre portion (38).

8. A boxing machine as claimed in claim 7, characterised by the fact that the said tubular bending assembly comprises actuating means (70) designed to move the said boxing frame (57) between a lowered position, underneath the said plate (24), and a raised position, partially over the said plate (24), through the said opening (29) in the same; the said boxing frame (57) being provided with first (71) and second (66, 68) bending means designed to cooperate with the said blank (37) in the said position covering the said opening (29), in such a manner as respectively and simultaneously to bend squarely upwards the said lateral tongues (41), and to bend upwards the said four tabs (39, 40).

9. A boxing machine as claimed in claim 8, characterised by the fact that the said first (71) and second (66, 68) bending means are integral with and extend upwards from the said boxing frame (57); the said first bending means (71) being of greater height than the said second bending means (66, 68).

10. A boxing machine as claimed in claim 8, characterised by the fact that the said pushing means comprise a top pusher (33) and a bottom pusher (31) arranged opposite each other and designed to cooperate with the said group (2) in the said boxing position; the said top pusher (33) being designed to move, through the said box-shaped pocket member (23) in the said boxing position, the said retaining frame (36), the said opening (29) in the said plate (24), and the said boxing frame (57), between a raised position, over the said box-shaped pocket member (23) in the said boxing position, and a lowered position beneath the said boxing frame (57) in its said lowered position; the said bottom pusher (31) being designed to move, through the said opening (29) in the said plate (24), and the said boxing frame (57), between a raised position contacting the underside of the said blank (37) in the said position covering the said opening (29), and a lowered position beneath the said lowered position of the said top pusher (33), the clearance between the two said lowered positions being substantially equal to the height of a said group (2) of items (3); the said bottom pusher (31), when in the said lowered position, being designed to support the said group (2) of items (3) in the said unloading position.

11. A boxing machine as claimed in claim 10, characterised by the fact that it also comprises unloading conveyor means (73), on a level with the said bottom pusher (31) in its said lowered position, and unloading push means (74) designed to engage a boxed said group (2) of items (3) on the lowered said bottom pusher (31), and to transfer it onto the said unloading conveyor means (73); the said unloading push means (74) comprising a substantially C-shaped push member (75) of such a size as to enable the passage of a shaft (80) for activating the said bottom pusher (31).

12. A boxing machine as claimed in claim 1, characterised by the fact that it also comprises an indexing fixture (18) over the said plate (24); two said box-shaped pocket members (23) being supported on the said indexing fixture (18), one in the said loading position and the other in the said boxing position, in such a manner as to enable the said positions to be inverted simultaneously.

* * * * *